United States Patent [19]

Ortwein

[11] Patent Number: 4,577,801

[45] Date of Patent: Mar. 25, 1986

[54] ELASTOMERIC MOUNTING FOR RAILWAY RAIL WITH DIFFERENTLY ANGLED FLANKS

[75] Inventor: Hermann Ortwein, Cologne, Fed. Rep. of Germany

[73] Assignee: Clouth Summiwerke Aktiengesellschaft, Cologne, Fed. Rep. of Germany

[21] Appl. No.: 292,789

[22] Filed: Aug. 14, 1981

[30] Foreign Application Priority Data

Aug. 16, 1980 [DE] Fed. Rep. of Germany ..... 3030937

[51] Int. Cl.[4] ..... E01B 9/38

[52] U.S. Cl. ..... 238/283; 238/25; 238/382

[58] Field of Search ..... 238/283, 284, 285, 310, 238/382, 193, 25, 310, 349

[56] References Cited

U.S. PATENT DOCUMENTS

| | | | |
|---|---|---|---|
| 1,682,665 | 8/1928 | Day | 238/25 |
| 4,266,719 | 5/1981 | Ortwein et al. | 238/283 |
| 4,275,832 | 6/1981 | Kenyon | 238/310 |

FOREIGN PATENT DOCUMENTS

| | | | |
|---|---|---|---|
| 2828714 | 1/1980 | Fed. Rep. of Germany | 238/193 |
| 2901283 | 7/1980 | Fed. Rep. of Germany | 238/193 |
| 2933541A | 3/1981 | Fed. Rep. of Germany | 238/382 |
| 1060574 | 11/1953 | France | 238/193 |
| 2410087 | 6/1979 | France | 238/349 |
| 200039 | 2/1965 | Sweden | 238/283 |

*Primary Examiner*—Randolph A. Reese

*Attorney, Agent, or Firm*—Karl F. Ross; Herbert Dubno

[57] ABSTRACT

A mounting for one rail of a pair of railroad rails having inner sides turned toward each other and outer sides turned away from each other comprises a base supported on the ground under the one rail and formed with an upwardly open recess having inner and outer base side flanks respectively generally under and parallel to the inner and outer sides and end base flanks extending between the side base flanks and transverse to the rail. These side flanks form with the vertical an angle normally between 0° and 10° different from the angle of between 15° and 80° of the end flanks. An insert is attached to the rail, received in the recess, and has respective side and end insert flanks juxtaposed with, generally parallel to, and spaced from the respective base flanks. Respective side and end elastomeric bodies lie between the base and insert flanks and supporting the insert in the recess of the base.

9 Claims, 5 Drawing Figures

Fig.1
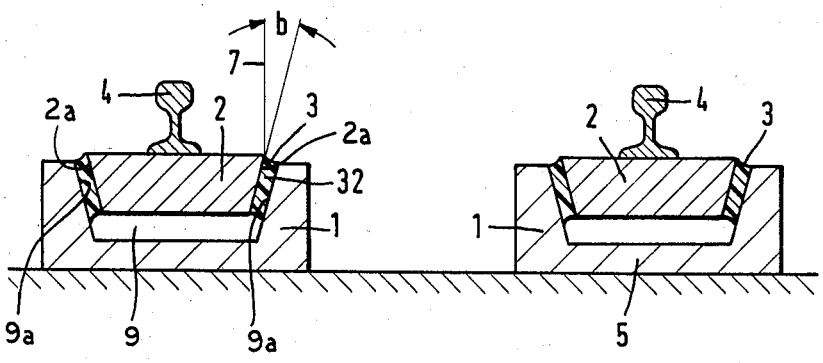
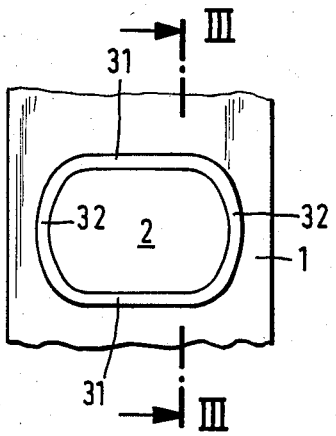
Fig.2
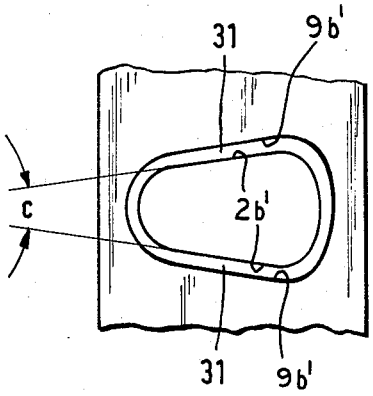
Fig.4
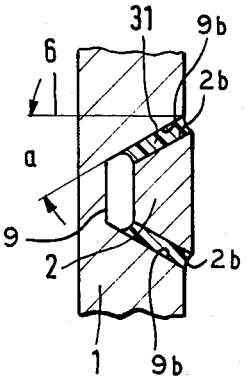
Fig.3
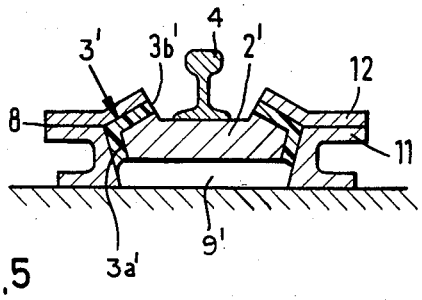
Fig.5

ELASTOMERIC MOUNTING FOR RAILWAY RAIL WITH DIFFERENTLY ANGLED FLANKS

FIELD OF THE INVENTION

The present invention relates to an elastomeric mounting for a railway rail. More particularly this invention concerns such a mounting which is aimed at reducing the noise generated as a railway car wheel rolls along its rail.

BACKGROUND OF THE INVENTION

It is standard practice, as for example described in U.S. Pat. 4,266,719 and the references cited thereagainst, to mount a railway rail on at least one insert which is received in a recess formed in a normally concrete rigid base that is fixed on the ground. A layer of an elastomer is provided between the insert and the side and end flanks of the recess to suspend the insert in the recess. The elastomer damps sound transmission between the rail and the base, allowing a train to run along the rail substantially more silently than would otherwise be possible.

The recess and insert are normally complementarily shaped, and are both normally also symmetrical about a pair of mutually perpendicular vertical symmetry planes, one extending parallel to and through the center of the rail they support and the other extending perpendicular through the rail they support. The angle these flanks form with the vertical is the same. The stress they are subject to is, however, not the same. Nonetheless when such inserts and bases that are symmetrical as described above are employed a flank angle is chosen which is a compromise that more or less is satisfactory for each flank of the insert.

The problem with such arrangements is that they occasionally fail, with the elastomeric bodies shearing on one flank or the other. Attempts to refigure the flank angle to eliminate such failure at one flank normally simply lead to failure at another flank.

OBJECTS OF THE INVENTION

It is therefore an object of the present invention to provide an improved elastomeric mounting for a railway car rail.

Another object is to provide such a mounting which overcomes the disadvantages of the known mountings.

SUMMARY OF THE INVENTION

These objects are attained according to the instant invention in a mounting for one rail of a pair of railroad rails having inner sides turned toward each other and outer sides turned away from each other. The mounting according to the instant invention comprises a base supported on the ground under the one rail and formed with an upwardly open recess having inner and outer base side flanks respectively generally under and parallel to the inner and outer sides and end base flanks extending between the side base flanks and transverse to the rail. These side flanks form with the vertical an angle different from that of the end flanks. An insert is attached to the rail, received in the recess, and has respective side and end insert flanks juxtaposed with, generally parallel to, and spaced from the respective base flanks. Respective side and end elastomeric bodies lie between the base and insert flanks and supporting the insert in the recess of the base.

Since the side-to-side resistance to displacement need normally not be as great as the front-to-back resistance, according to another feature of this invention, the end flanks form with the vertical a larger angle than the side flanks. More particularly, these end flanks form with the vertical an angle of between 15° and 80°. The side flanks form with the vertical an angle of between 0° and 10°. In this manner the vectors of the force transmitted between the insert and the base are adjusted to optimal values.

In accordance with another feature of this invention, at least the side flanks are curved and concave toward each other. In addition the said end flanks are inclined toward each other and are closer together at the inner flank than at the outer flank. The end flanks may according to this invention be straight and form with each other an angle of at most 45°.

The side flanks according to another feature of this invention have lower sections inclined away from each other and upper sections inclined toward each other. To this end the base has an upper part and a lower part respectively at the levels of said upper and lower sections. Thus the base is split into two parts at the plane between these sections and is normally held together by vertical bolts.

DESCRIPTION OF THE DRAWING

The above and other features and advantages will become more readily apparent from the following, reference being made to the accompanying drawing in which:

FIG. 1 is a vertical section through the mounting according to the instant invention;

FIG. 2 is a plan view of the left-hand mounting of FIG. 1;

FIG. 3 is a section taken along line III—III of FIG. 2;

FIG. 4 is a view similar to FIG. 2 showing another mounting according to this invention in plan view; and FIG. 5 is a vertical section through another mounting according to this invention.

SPECIFIC DESCRIPTION

As seen in FIGS. 1–3, a concrete base 1 which extends longitudinally and generally parallel to a rail 4 is formed with a recess 9 having a pair of side flanks **9*a* and a pair of end flanks 9*b* (FIG. 3). An insert 2 has complementary side flanks 2*a* and end flanks 2*b* and is fixed by bolts or other conventional means to the rail 4**.

The flanks **2*b* and 9*b* form with the a vertical plane 6 as shown in FIG. 3 an angle a equal to between 15° and 80°. Similarly the flanks 2*a* and 9*a* form with a vertical plane 7 as shown in FIG. 1** an angle b which is between 0° and 10°.

As seen from the top in FIG. 2 the space between the flanks **2*b* and 9*b* is filled with straight sections 31 of an elastomeric insulating body 3 having inwardly concave sections 32 filling the spaces between the parallel flanks 2*a* and 9*a*. The material of this annular body 3 is a natural or synthetic elastomer which is bonded to both parts 1 and 2. In effect the insert 2 is potted in the recess 9 by the elastomeric body 3**.

FIG. 4 shows an arrangement identical to that of FIGS. 1–3 except that the front and rear end flanks **2*b*′ and 9*b*′ extend at an angle c of at most 45° to each other. These flanks 2*b*′ and 9*b*′** in fact converge toward the center of the tracks, that is toward the other rail.

Finally FIG. 5 shows an arrangement wherein a base is formed of a lower part 11 and an upper part 12 joined together at a plane 8. The body 3′ is subdivided into a downwardly converging annular lower section **3*a*′ and an upwardly converging upper section 3b' joined at the plane 8. The two parts 11 and 12 may be bolted or welded together and the insert 2' is of course complementary to the recess 9'** formed by them.

Thus the system according to the instant invention allows the angles to be set to correspond to the exact stresses that the mounting will encounter in use. The steeper side sections 32 will be stressed mainly in compression, whereas the less steep front and rear end sections will be stressed mainly in shear. This allows the system to exactly match service requirements. In particular the front-to-rear springiness can be substantially less than the side-to-side springiness or resistance to displacement, for best noise control with maximum dimensional stability.

I claim:

1. A mounting for one rail of a pair of railroad rails having inner sides turned toward each other and outer sides turned away from each other, said mounting comprising:

a base supported on the ground under said one rail and formed with an upwardly open recess having inner and outer base side flanks respectively generally under and parallel to said inner and outer sides and end base flanks extending between said side base flanks and transverse to said rail, said side flanks forming with the vertical an angle different from that of said end flanks;

an insert attached to said rail, received in said recess, and having respective side and end insert flanks juxtaposed with, generally parallel to, and spaced from the respective base flanks; and respective side and end elastomeric bodies lying between said base and insert flanks and supporting said insert in said recess of said base.

2. The mounting defined in claim 1 wherein said end flanks form with the vertical a larger angle than said side flanks.

3. The mounting defined in claim 2 wherein said end flanks form with the vertical an angle of between 15° and 80°.

4. The mounting defined in claim 3 wherein said side flanks form with the vertical an angle of between 0° and 10°.

5. The mounting defined in claim 1 wherein at least said side flanks are curved and concave toward each other.

6. The mounting defined in claim 1 wherein said end flanks are inclined toward each other and are closer together at said inner flank than at said outer flank.

7. The mounting defined in claim 6 wherein said end flanks are straight and form with each other an angle of at most 45°.

8. The mounting defined in claim 1 wherein said side flanks have lower sections inclined away from each other and upper sections inclined toward each other.

9. The mounting defined in claim 8 wherein said insert has an upper part and a lower part respectively at the levels of said upper and lower sections.

* * * * *

UNITED STATES PATENT AND TRADEMARK OFFICE

CERTIFICATE OF CORRECTION

PATENT NO. : 4,577,801

DATED : March 25, 1986

INVENTOR(S) : Hermann ORTWEIN

It is certified that error appears in the above-identified patent and that said Letters Patent is hereby corrected as shown below:

On the title page:

Item [73] Assignee's name to be corrected to read:

-- Clouth Gummiwerke Aktiengesellschaft--

Signed and Sealed this

*Nineteenth* Day of *August 1986*

[SEAL]

*Attest:*

DONALD J. QUIGG

*Attesting Officer*

*Commissioner of Patents and Trademarks*